US005462136A

United States Patent [19]

Schoenmaker et al.

[11] Patent Number: 5,462,136

[45] Date of Patent: Oct. 31, 1995

[54] PREVENTION OF SLACK LIFT CHAINS ON A MAN-UP LIFT TRUCK

[75] Inventors: John Schoenmaker, Greene; Gene R. Mathes, Binghamton, both of N.Y.

[73] Assignee: The Raymond Corporation, Greene, N.Y.

[21] Appl. No.: 205,219

[22] Filed: Mar. 3, 1994

[51] Int. Cl.[6] ..... B66B 9/20

[52] U.S. Cl. ..... 187/223; 187/229

[58] Field of Search ..... 187/9 R, 9 E, 187/140, 110, 105, 223, 229; 182/63, 148

[56] References Cited

U.S. PATENT DOCUMENTS

| | | | |
|---|---|---|---|
| 4,252,491 | 2/1981 | Hock | 187/9 R |
| 4,499,971 | 2/1985 | Luebrecht et al. | 187/9 R |
| 5,238,086 | 8/1993 | Aoki et al. | 187/9 R |

*Primary Examiner*—Kenneth Noland

*Attorney, Agent, or Firm*—Salzman & Levy

[57] ABSTRACT

The present invention features a method and an apparatus for preventing lift chains from becoming slack in a lift truck with a "man-up" feature installed. Lift trucks are generally those vehicles that feature hydraulically controlled lift masts with a chain supported fork carriage. Operators of these lift vehicles with the remote lift and lower feature are generally lifted and lowered by these masts, known in the trade as a "man-up" condition. It is quite desirable to prevent a slack chain condition in the man-up mast position. The invention features a pressure transducer for monitoring a drop in hydraulic fluid pressure established by the flow control valve that regulates the lowering speed of the mast during the remote mode, i.e., when the fork carriage is being lowered by the operator in the platform attached to the fork carriage. The invention turns off the normally closed load-holding valve when the hydraulic pressure drops below a predetermined value, which stops the flow of hydraulic fluid back into the reservoir. This, in turn, stops the cylinder(s) from lowering and keeps the fork carriage lift chains from becoming slack.

8 Claims, 3 Drawing Sheets

PREVENTION OF SLACK LIFT CHAINS ON A MAN-UP LIFT TRUCK

FIELD OF THE INVENTION

The present invention pertains to material handling vehicles, and, more particularly, to a method and an apparatus for preventing lift chains from becoming slack on a lift truck during the fork-lowering procedure.

BACKGROUND OF THE INVENTION

Lift trucks with the remote lift and lower feature installed are also known in the trade as "man-up" vehicles. These vehicles feature an operator station that is mounted on, and travels with, a fork carriage supported by an extendable mast. The extendable mast and fork carriage raises and lowers the operator's station. The operator will often stand on a platform attached to the forks and operate the remote lift and lower controls. The controls are initiated by turning a key switch to activate the remote mode. The remote mode of operation restricts all other functions, such as vehicular travel, fork reach, fork retract, fork sideshift and the fork tilt. This configuration uses a controlled lift/lower speed function. The speed is predetermined by the setting of a hydraulic flow-control valve that regulates the fluid supplied to or released from the lift cylinders.

During the controlled lowering of the lift forks, the above system will experience a drop in hydraulic pressure between the lift cylinders and the flow control valve when an obstruction prevents lowering. This drop in hydraulic pressure causes the lift chains on the cylinder(s) to become slack. The fork-lowering procedure can then become erratic and non-uniform if the obstruction is suddenly removed.

Recent lift truck designs have included a pressure transducer in the hydraulic circuitry to monitor the weight being supported upon the forks. This pressure transducer also determines whether to utilize a second stage hydraulic pump in a tandem pump system if a preset pressure has not been exceeded.

The present invention provides a method to utilize this pressure transducer for monitoring the hydraulic pressure during the remote mode, i.e., when the operator's platform is being lowered. The invention turns off the normally closed load-holding value when the pressure drops below a predetermined value, which stops the flow of hydraulic fluid back into the reservoir. This, in turn, stops the cylinder(s) from lowering, and keeps the fork carriage lift chains from becoming slack.

DISCUSSION OF RELATED ART

In U.S. Pat. No. 4,499,971 (issued to Luebrecht et al on Feb. 19, 1985, for MATERIAL HANDLING VEHICLE HAVING IMPROVED CHAIN MONITORING, a system is illustrated for determining when a lift chain has broken or become slack. The patent teaches detection of the slack chain condition, but, unlike the present invention, does nothing to prevent the chain from becoming slack.

SUMMARY OF THE INVENTION

In accordance with the present invention, there are provided a method and an apparatus for preventing lift chains from becoming slack in a lift truck with a "man-up" feature installed. These trucks are generally vehicles that feature hydraulically controlled lift masts with a chain supported fork carriage. Operators of these vehicles with the remote lift and lower feature are generally lifted and lowered by these masts, known in the trade as a "man-up" condition. For safe and efficient operation, it is quite desirable to prevent a slack chain condition in the man-up mast position. The invention features a pressure transducer for monitoring a drop in hydraulic fluid pressure established by the flow control valve that regulates the lowering speed of the mast during the remote mode, i.e., when the fork carriage is being lowered by the operator in the platform attached to the fork carriage. The invention turns off the normally closed load-holding valve when the hydraulic pressure drops below a predetermined value, which stops the flow of hydraulic fluid back into the reservoir. This, in turn, stops the cylinder(s) from lowering and keeps the fork carriage lift chains from becoming slack.

It is an object of this invention to provide an improved remote mode handling of the mast movement in a lift truck.

It is a further object of this invention to provide a system and a method for preventing the lift chains from becoming slack during the man-up operation of a lift truck's extension mast.

BRIEF DESCRIPTION OF THE DRAWINGS

A complete understanding of the present invention may be obtained by reference to the accompanying drawings, when considered in conjunction with the subsequent detailed description, in which.

FIG. *2a* shows an alternate embodiment of the hydraulic lift system circuit of this invention.

DESCRIPTION OF THE PREFERRED EMBODIMENT

Generally speaking, when a lift truck is in the "man-up" operation, a condition may arise wherein the lift chain of the fork carriage may become slack. The present invention features a method and a system for preventing this occurrence. The slack condition remedied by the invention usually occurs when the fluid pressure established by the hydraulic flow-control valve (that regulates the lowering of the mast during the remote mode) drops below a given level necessary to maintain the chain tension. At this time, the invention turns off the normally closed load-holding valve, which stops the flow of the hydraulic fluid back into the reservoir. This, in turn, stops the cylinder(s) from lowering and keeps the fork carriage lift chains from becoming slack.

Figure 1:
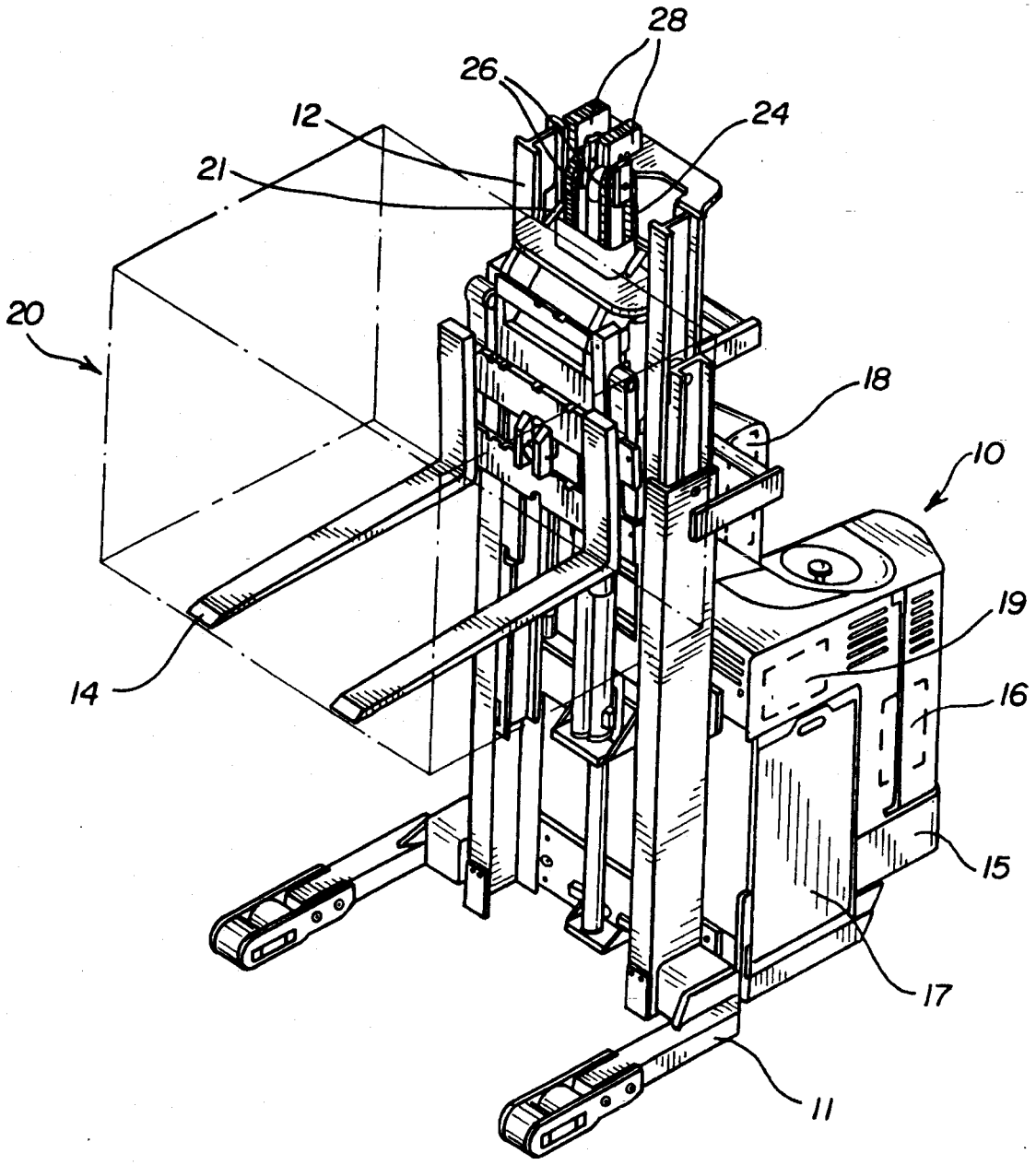
FIG. 1 illustrates a schematic, isometric view of a lift truck of the type in which the current slack-chain prevention system and method of this invention are used.

Now referring to FIG. 1, a typical lift truck 10 in which the present invention can be used is illustrated. The vehicle 10 comprises a base 11 upon which a telescoping extension mast 12 supports a pair of forks 14. An operator of the vehicle rides upon the forks 14 in an attached operator's station shown generally by arrow 20. The operator controls the forks 14 by means of a remote control panel 21. The base 11 also supports a drive and control system disposed in a housing 15. The drive and control system features a vehicular DC drive motor 16; a bank of batteries 17 for powering the DC drive motor 16; a control unit 18 that is programmed to control the lift truck in various modes of operation; and a hydraulic power unit 19 for raising and lowering the mast 12.

Typical extension mast 12 operation involves a first stage of lift, wherein a chain 24 is used to raise and lower the forks 14. The chain 24 is supported upon two sprocket wheels 26, and side cylinders 28, which maintain the proper tension in the chain 24 during the raising or lowering of the mast 12, as shown. Subsequent height extension or retraction of the mast 12 is achieved by activating the telescoping stages of extension mast 12.

Figure 2:
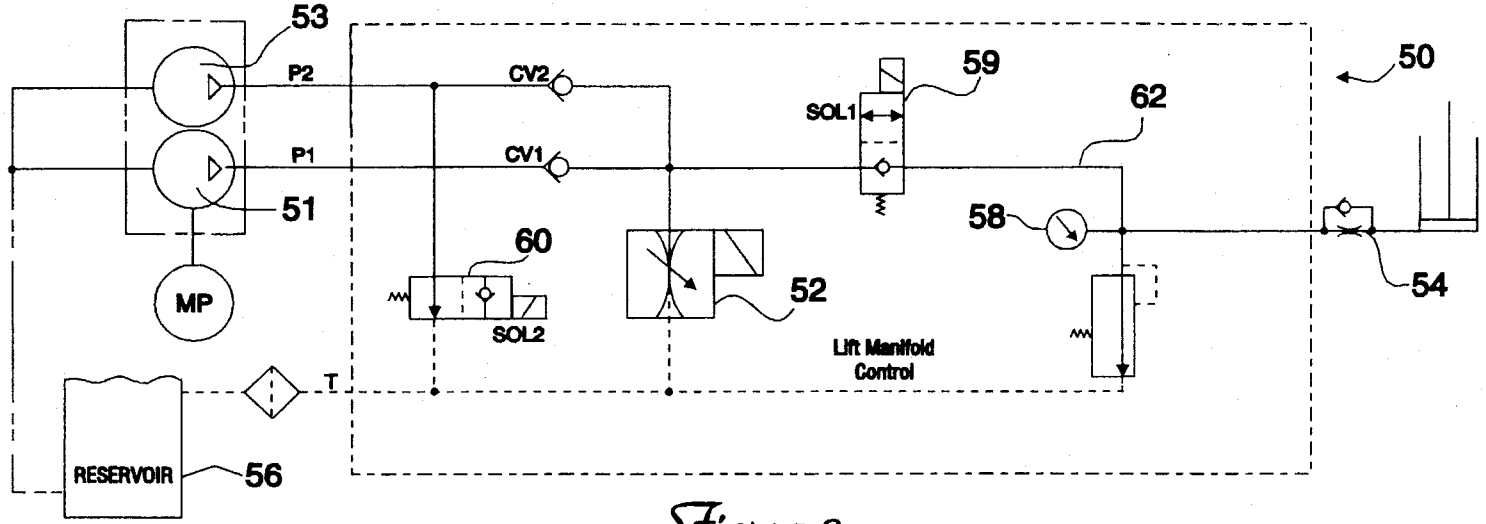
FIG. 2 depicts a circuit diagram of the hydraulic lift system of the invention.

Referring to FIG. 2, a hydraulic circuit 50 of this invention is shown. The circuit of FIG. 2 features two fluid pumps 51 and 53, respectively, for pressurizing the lift cylinder 54 that raises or lowers the extension mast 12. The proportional fluid flow valve 52, in the preferred embodiment, is used in the hydraulic system for controlling the speed by which the lift cylinder 54 raises or lowers the mast 12. It accomplishes this by diverting a portion of the hydraulic fluid used to drive the lift cylinder 54 back into the reservoir 56. It should be understood that other electrical or mechanical fluid flow valves for controlling speed of the lift cylinder(s) can be used, rather than the proportional fluid flow valve of the preferred embodiment. Such other valves include manual spool valves, solenoids, or any other mechanisms that control fluid flow.

It is during the stage(s) of mast extension (one of which is referred to as "free lift") that the present invention is directed. In particular, experience has proven that the lift chain 24 may go slack during the remote mode of operation. This mode of operation is characterized by a disablement of all vehicle operations other than remote lifting and lowering of the forks 14. It is during this remote lowering operating phase that the pressure in line 62, controlled by the proportional fluid flow valve 52 may drop, because of an obstruction, to a level that will not support the tension in the lift chain 24.

The invention utilizes the pressure transducer 58 that normally monitors the weight being supported upon the lift forks 14. In a tandem pump system this pressure transducer also determines whether to utilize the second hydraulic pump 53, if the pressure in the hydraulic line 62 is within a predetermined range. This transducer 58, in accordance with the invention, is now used to monitor the drop in the hydraulic fluid pressure in the hydraulic line 62 controlled by the flow-control valve 52 that regulates fluid flow to the lift cylinder 54, and, hence, the lowering of the mast and attached operator's station during the remote mode (when the fork lift is being lowered). The transducer 58 turns off the normally closed load-holding valve 59 (via the control unit 18 of FIG. 1), which in turn stops the flow of the hydraulic fluid back into the reservoir 56. This, in turn, stops the side cylinders 28 from lowering and keeps the lift chain 24 from becoming slack.

Figure 3:
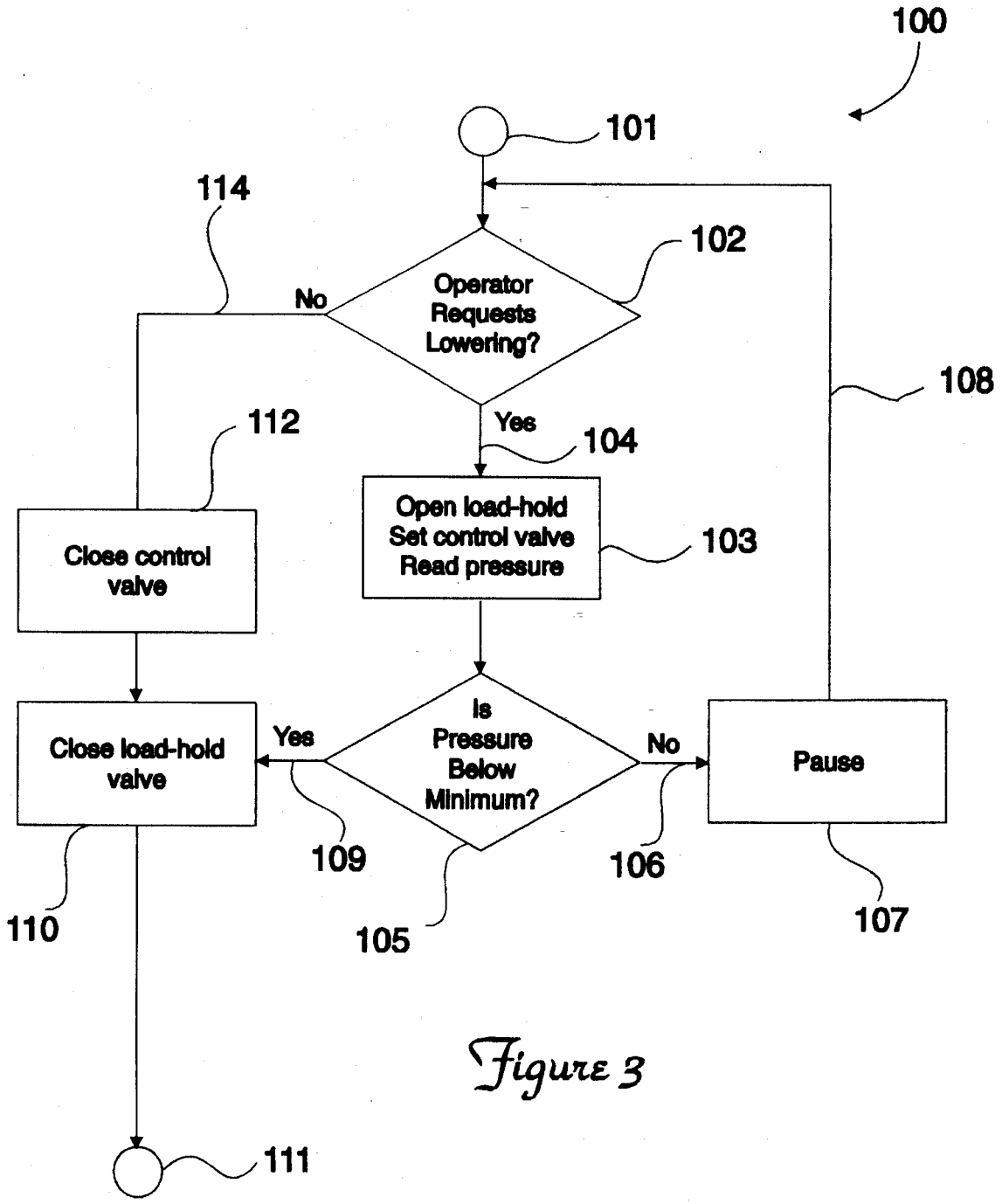
FIG. 3 illustrates a flow diagram of the method of controlling the extension mast of a lift truck, in accordance with the system of the invention shown in FIGS. 2 and *2a*.

The control unit 18 of FIG. 1 is programmed to use the signal generated by the pressure transducer 58 to close the holding solenoid 58, as depicted by the flow chart program shown in FIG. 3, to which reference is now made. A control unit subroutine 100 features the initialization, step 101, of the lowering procedure. When the operator requests a lowering of the forks 14 (FIG. 1), step 102, the load-holding valve 59 is opened, step 103, which valve is normally in the closed position. The pressure level in the hydraulic line 62 controlled by fluid control valve 52 is established. The pressure level of the hydraulic line 62, sensed by the transducer 58, is determined to be at a proper or improper operating level, step 105. If the pressure is not below the minimum necessary to maintain chain 24 in tension, line 106, the system pauses, step 107, and loops back to the lowering request, step 102, via line 108. This ensures that the lowering request is constantly monitored. However, should the transducer 58 signal that the pressure in the hydraulic line 62 is below the required minimum, line 109, the load-holding valve 59 is closed, step 110, so that fluid will not return to reservoir 56. The subroutine 100 is then exited at step 111.

In the event that the operator has not requested a lowering of the forks, line 114, the flow-control valve 52 is closed, step 112, and the load-holding valve 59 is closed, step 110. The subroutine 100 is then exited at 111.

Figure 2A:
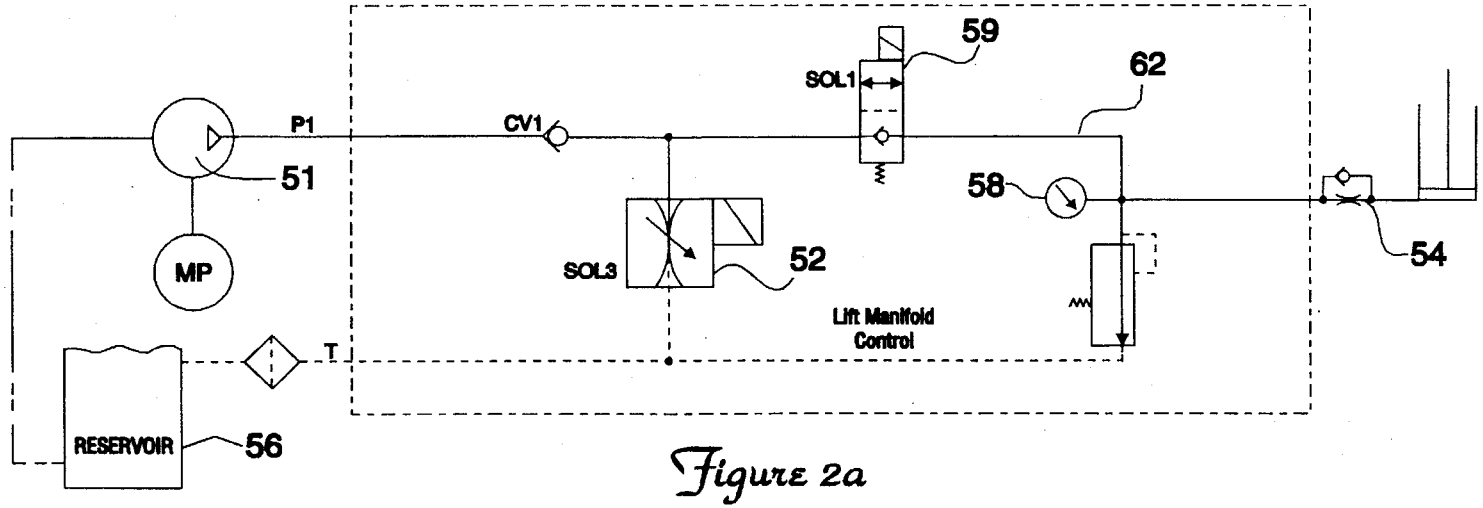

Referring to FIG. 2*a*, a second embodiment of the circuit 50 of this invention is shown. In this embodiment, the second pump 53 and the second stage solenoid 60 have been deleted. This circuit is used when the extension mast does not feature a tandem pump system.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. For example, while reach trucks with a remote lift and lower feature have been described in detail hereinabove, it should be understood that the invention has applicability also to all "man-up" vehicles, including order pickers, reach vehicles, swing-reach vehicles, etc.

Having thus described the invention, what is desired to be protected by Letters Patent is presented in the subsequently appended claims.

What is claimed is:

1. A hydraulic circuit for controlling chain slackness in a lift mast, comprising:

a fluid reservoir;

a lift mast and a chain, said lift mast being capable of being raised or lowered hydraulically;

a lift cylinder operatively connected to said lift mast for raising and lowering said lift mast;

at least one fluid pump disposed between said fluid reservoir and said lift cylinder for pumping hydraulic fluid from said reservoir to said lift cylinder;

a fluid flow valve disposed between said reservoir and said at least one fluid pump for regulating fluid flow to said lift cylinder, hence controlling the raising and lowering of said lift mast;

a load-holding valve disposed between said lift cylinder and said reservoir;

a transducer operatively connected to said fluid flow valve for sensing fluid pressure in said fluid flow valve, and, in response to a given low-pressure level, generating a signal; and a controller operatively connected to said transducer and said load-holding valve, said controller blocking fluid flow through said load-holding valve in response to said signal, whereby said lift mast will be prevented from lowering and said chain from slackening.

2. The hydraulic circuit in accordance with claim 1, wherein said lift mast is operative in a remote mode, wherein the raising and lowering of said lift mast are the only possible operative functions.

3. The hydraulic circuit in accordance with claim 1, wherein said controller is programmable to prevent said chain from slackening.

4. The hydraulic circuit in accordance with claim 1, in combination with a reach truck.

5. A hydraulic system for controlling chain slackness in a lift mast, comprising:

a fluid reservoir;

a lift mast and a chain, said lift mast being capable of being raised or lowered hydraulically;

a lift cylinder operatively connected to said lift mast for raising and lowering said lift mast;

a fluid flow valve disposed between said reservoir and said lift cylinder for regulating fluid flow to said lift cylinder, hence controlling the raising and lowering of said lift mast;

a load-holding valve disposed between said lift cylinder and said reservoir;

a transducer operatively connected to said fluid flow valve for sensing fluid pressure therein and, in response to a given low-pressure level, generating a signal; and a controller operatively connected to said transducer and said load-holding valve, said controller blocking fluid flow through said load-holding valve in response to said signal, whereby said lift mast will be prevented from lowering, and hence preventing a slackening of said chain.

6. The hydraulic system in accordance with claim 5, in combination with a reach truck.

7. The hydraulic system in accordance with claim 5, wherein said lift mast is operative in a remote mode, wherein the raising and lowering of said lift mast are the only possible operative functions.

8. The hydraulic system in accordance with claim 5, wherein said controller is programmable.

* * * * *